US005829395A

United States Patent [19]

Brenny et al.

[11] Patent Number: 5,829,395

[45] Date of Patent: Nov. 3, 1998

[54] RAIL SAW POWER HEAD WITH TWO CYCLE ENGINE AND LUBE OIL METERING SYSTEM

[75] Inventors: David M. Brenny, Eagle; Gary L. Johnson, Racine, both of Wis.

[73] Assignee: Racine Railroad Products, Inc., Racine, Wis.

[21] Appl. No.: 646,779

[22] Filed: May 8, 1996

[51] Int. Cl.[6] ..... F04B 43/06

[52] U.S. Cl. ..... 123/73 AD

[58] Field of Search ..... 123/73 AD, 73 C, 123/196 R; 184/6.8

[56] References Cited

U.S. PATENT DOCUMENTS

| | | | |
|---|---|---|---|
| 3,772,830 | 11/1973 | Hambrick . | |
| 3,809,185 | 5/1974 | Kobayashi et al. . | |
| 3,924,975 | 12/1975 | Hundertmark . | |
| 3,974,596 | 8/1976 | Huboud-Peron . | |
| 4,033,074 | 7/1977 | Lutts . | |
| 4,068,415 | 1/1978 | McIlrath . | |
| 4,305,351 | 12/1981 | Staerzl . | |
| 4,471,727 | 9/1984 | Odashima | 123/73 AD |
| 4,512,292 | 4/1985 | Hundertmark . | |
| 4,539,949 | 9/1985 | Walsworth | 123/73 AD |
| 4,583,500 | 4/1986 | Hundertmark . | |
| 4,637,355 | 1/1987 | Odashima | 123/73 AD |
| 4,697,553 | 10/1987 | Lie | 123/73 AD |
| 4,700,668 | 10/1987 | Schierling et al. . | |
| 4,726,330 | 2/1988 | Shiga | 123/73 AD |
| 4,750,464 | 6/1988 | Staerzl . | |
| 4,765,098 | 8/1988 | Duff et al. . | |
| 4,802,555 | 2/1989 | Matsunaga et al. . | |
| 4,821,688 | 4/1989 | Slattery | 123/73 AD |
| 4,873,902 | 10/1989 | Krieg . | |
| 4,876,993 | 10/1989 | Slattery | 123/73 AD |
| 4,887,559 | 12/1989 | Hensel et al. | 123/73 AD |
| 4,928,390 | 5/1990 | Gassen et al. . | |
| 4,955,943 | 9/1990 | Hensel et al. . | |
| 4,976,246 | 12/1990 | Schierling et al. . | |
| 4,996,105 | 2/1991 | Mori | 123/73 AD |
| 5,214,864 | 6/1993 | Tasaki et al. . | |
| 5,239,967 | 8/1993 | Adam . | |
| 5,315,971 | 5/1994 | Yamada | 123/73 AD |
| 5,377,637 | 1/1995 | Leighton et al. . | |

OTHER PUBLICATIONS

Husqvarna (brochure) 3120 Jan. 1994 Spare Parts (106 22 77–62) 2 pages.

*Primary Examiner*—Marguerite McMahon
*Attorney, Agent, or Firm*—Nilles & Nilles

[57] ABSTRACT

A rail saw has a power head which includes a two cycle engine which does not require premixing of gasoline and lubricating oil. Instead, undiluted gasoline is stored in the engine's fuel tank, and lubricating oil is supplied to the engine's fuel supply system downstream of the fuel tank by a mechanical metering pump which delivers a designated, preferably adjustable, quantity of oil to the fuel supply system per engine revolution. In the case of a power head formed by converting a chain saw power head to a rail saw power head, the oil supply system may comprise the lubricating oil system originally designed to lubricate the chain saw's chain. Also disclosed is a preferred method of converting a chain saw power head requiring the storage of a premixed gasoline/lubricating oil mixture in its fuel tank to a rail saw power head whose fuel tank stores gasoline only.

17 Claims, 4 Drawing Sheets

RAIL SAW POWER HEAD WITH TWO CYCLE ENGINE AND LUBE OIL METERING SYSTEM

BACKGROUND OF THE INVENTION

1. Field of the Invention

The invention relates to rail saws and, more particularly, to: 1) a rail saw having a power head which incorporates a two cycle engine and which has a lube oil metering system which permits the engine to run on straight gasoline, 2) an engine usable in said power head, and 3) a method of converting a conventional chain saw power head to a lube oil metered rail saw power head. The invention further relates power heads usable in applications other than rail saws, the two cycle engines of which have lube oil metering systems which permit the engines to run on straight gasoline.

2. Discussion of the Related Art

Many railroad right-of-way maintenance and construction operations must be performed in situ. For example, rails frequently must be cut to size after being secured to ties in the conventional manner. Hand operated rail saws have proven well-suited for this task.

The typical hand operated rail saw includes a rotary abrasive cutting disc driven by a power head. The power head includes a casing, a two cycle engine disposed in the casing, and a support bar or boom for the cutting disc mounted on the casing. The cutting disc is driven by a V belt drive device. As is standard with two cycle engines, the engine is fueled by a premixed gasoline/lubricating oil mixture which is mixed with air in a carburetor and admitted to the engine's combustion chamber in a conventional manner. A rail saw of this type is disclosed in U.S. Pat. No. 4,068,415 to McIlrath.

Rail saw power heads are typically formed from converted chain saw power heads because the power requirements of chain saws are akin to those of rail saws and because the bar and chain drive of a chain saw power head can be replaced relatively easily with the boom and belt drive of a rail saw power head. Chain saw power heads typically have a separate oil reservoir and oil metering system for lubricating the chain of the saw to prevent overheating. The oil metering systems historically were discarded or at least disabled when the chain saw power heads were converted for use as rail saw power heads. An example of a chain saw power head which is well suited for conversion to a rail saw power head is manufactured by Husqvarna, a Swedish corporation, under the Model No. 3120 (the Husqvarna power head). Other chain saw power heads which may be suitable for conversion for use as rail saw power heads are disclosed, for example, in U.S. Pat. No. 3,809,185 to Kobayashi et al.; U.S. Pat. No. 4,512,292 to Hundertmark; and U.S. Pat. No. 5,214,864 to Tasaki et al.

A problem associated with nearly all commercially available power heads, whether they be designed initially for use as a chain saw power head, a rail saw power head, or some other application, is that their engines are designed to burn a premixed mixture of gasoline and a lubricating oil. The premixed gasoline and oil are stored in the engine's fuel tank and fed as a mixture to the engine's carburetor upon demand. Of course, proper operation of the engine depends upon the operator's ability or willingness to properly premix the gasoline and lubricating oil in the tank. If too little oil is premixed with the gasoline, the engine is inadequately lubricated, can overheat, and may wear rapidly or even fail. If too much oil is premixed with the gasoline, engine performance is decreased and emissions increased. This problem is a serious one because the gasoline and oil often are mixed in the tank in the field under less than optimal conditions. The operator may not have the proper equipment to measure the required quantities of gasoline and oil or, typically being an employee who is less concerned about equipment maintenance and proper operation than the owner, simply might not be willing to expend the time and effort required to assure that gasoline and oil are premixed in the appropriate ratios. The inventors have discovered that the vast majority of power heads that are returned by users for repair or maintenance failed or required repair because gasoline and lubricating oil were not mixed in the tank in the proper proportions.

Various systems have been proposed to permit straight gasoline to be stored in a two cycle engine's fuel tank and to mix automatically lubricating oil with gasoline in the system's fuel supply system, thereby obviating the need to premix gasoline and oil in the tank, and at least theoretically overcoming the disadvantageous noted above. Examples of such systems are disclosed in U.S. Pat. No. 4,887,559 to Hensel et al.; U.S. Pat. No. 4,976,246 to Shierling et al.; U.S. Pat. No. 5,239,967 to Adam, and U.S. Pat. No. 5,377,367 to Layton. All of these patents propose the use of a somewhat complicated oil injection system to achieve the desired mixing. None of the oil injection systems disclosed by these patents is easily adapted for use with a conventional power head design. Moreover, all of these systems supply oil to the engine's fuel supply system whenever the engine is running, even when the engine is idling or otherwise does not require lubricating oil.

Still another problem associated with virtually any small engine having a lubricating oil system is that a cap must be removed to check the level of oil in the system's tank or reservoir. Requiring cap removal risks cap loss and/or introduction of dirt and debris into the tank and consequent damage to the engine. Operators are also less likely to check the oil level if they must physically remove the cap to do so.

OBJECTS AND SUMMARY OF THE INVENTION

It is therefore a first primary object of the invention to provide a two cycle engine which is usable in a power head such as that employed in a chain saw or rail saw, which does not require the storage of a premixed gasoline/lubricating oil mixture in its fuel tank, and which requires minimal modification to stock power head designs for its implementation.

A secondary object of the invention is to provide a two cycle engine which meets the first primary object of the invention and which is inexpensive to manufacture.

Another secondary object of the invention is to provide a two cycle engine which meets the first primary object of the invention and which does not unnecessarily lubricate the engine.

A second primary object of the invention is to provide a two cycle engine which is usable in a rail saw or the like and which employs a relatively simple and inexpensive mechanical oil metering system to mix lubricating oil with gasoline in the engine's fuel supply system, thereby obviating the need to premix the gasoline and oil.

In accordance with a first aspect of the invention, these objects are achieved by providing a two cycle engine comprising a cylinder having an intake port, a rotatable output shaft coupled to the cylinder, a fuel supply system, and an oil metering system. The fuel supply system supplies a mixture of air, fuel, and a lubricating oil to the intake port of the cylinder. The oil metering system supplies the lubricating oil to the fuel supply system and includes a source of the lubricating oil, and a metering pump having an oil inlet connected to the source of the lubricating oil and having an oil outlet connected to the fuel supply system. The metering pump is disabled when lubrication is unnecessary.

Preferably, the fuel supply system comprises a fuel source, an air source, and a carburetor connected to the fuel source and to the air source. The carburetor has an outlet in fluid communication with the intake port, a throttle plate located upstream of the outlet, and a venturi area located upstream of the throttle plate. The metering pump preferably supplies the lubricating oil to the venturi area.

Preferably, a clutch is provided which couples the gear to the output shaft when engaged and which is disengaged only when the engine is idling.

A third primary object of the invention is to provide a rail saw the power head of which has a two cycle engine which meets at least the first primary object of the invention.

In accordance with another aspect of the invention, this object is achieved by providing a rail saw comprising a two cycle engine, a rotary cutting disc, and a drive device. The engine is of the type constructed in accordance with the first primary aspect of the invention. The drive device is coupled to the clutch and to the cutting disc and drives the cutting disc to rotate only when the clutch is engaged.

A fourth primary object of the invention is to provide an oil source for an engine which does not require removal of a cap to check the oil level.

In accordance with another aspect of the invention, this object is achieved by providing a tank having a lower outlet and an upper opening, a cap which selectively closes the upper opening, and a sight glass. The sight glass has 1) a first end portion extending through in the cap and terminating in a first end visible from outside of the cap and 2) a second end portion extending into the tank and terminating in a second end. The first end is colored from reflected light when the second end is not submerged in oil and appears to be darkly colored when the second end is submerged in oil.

Preferably, indicia is marked on the second end portion of the sight glass to permit the sight glass to be used as a dipstick.

A fifth primary object of the invention is to provide a method of converting a power head which burns a premixed gasoline/oil mixture to a power head burning gasoline which is not premixed with oil.

In accordance with still another aspect of the invention, this object is achieved by first providing a power head including a two cycle engine, a driven component which is driven by the output shaft and which requires lubrication, and an oil supply system which is driven by the engine and which supplies a lubricating oil to the driven component. Subsequent steps include removing the driven component, and modifying the oil supply system to supply the lubricating oil to the engine.

The step of modifying preferably comprises attaching a first end of a tube to the outlet port of a metering pump and connecting a second end of the tube to the engine's carburetor.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a rail saw is provided the power head of which includes a two cycle engine which does not require premixing of gasoline and lubricating oil. Instead, undiluted gasoline is stored in the engine's fuel tank, and lubricating oil is supplied to the engine's fuel supply system downstream of the fuel tank by a mechanical metering pump which delivers a designated, preferably adjustable, quantity of oil to the fuel supply system per engine revolution. In the case of a power head formed by converting a chain saw power head to a rail saw power head, the oil supply system may comprise the lubricating oil system originally designed to lubricate the chain saw's chain. Also disclosed is a preferred method of converting a chain saw power head requiring the storage of a premixed gasoline/lubricating oil mixture in its fuel tank to a rail saw power head whose fuel tank stores gasoline only.

2. System Overview and Power Head Construction

Figure 1:
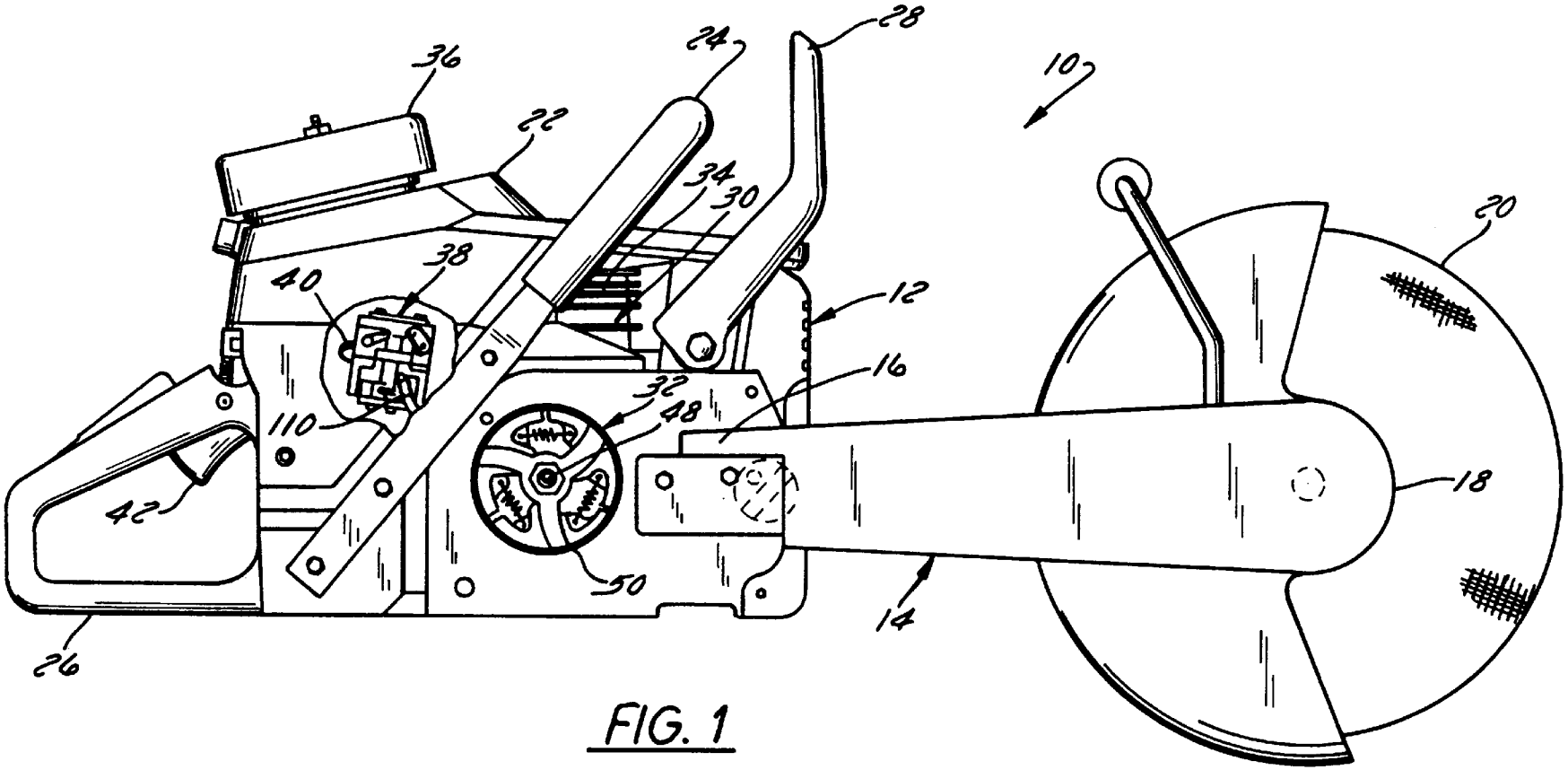
FIG. 1 is a partially cut away side elevation view of a rail saw employing a power head constructed in accordance with a preferred embodiment of the present invention.
Figure 2:
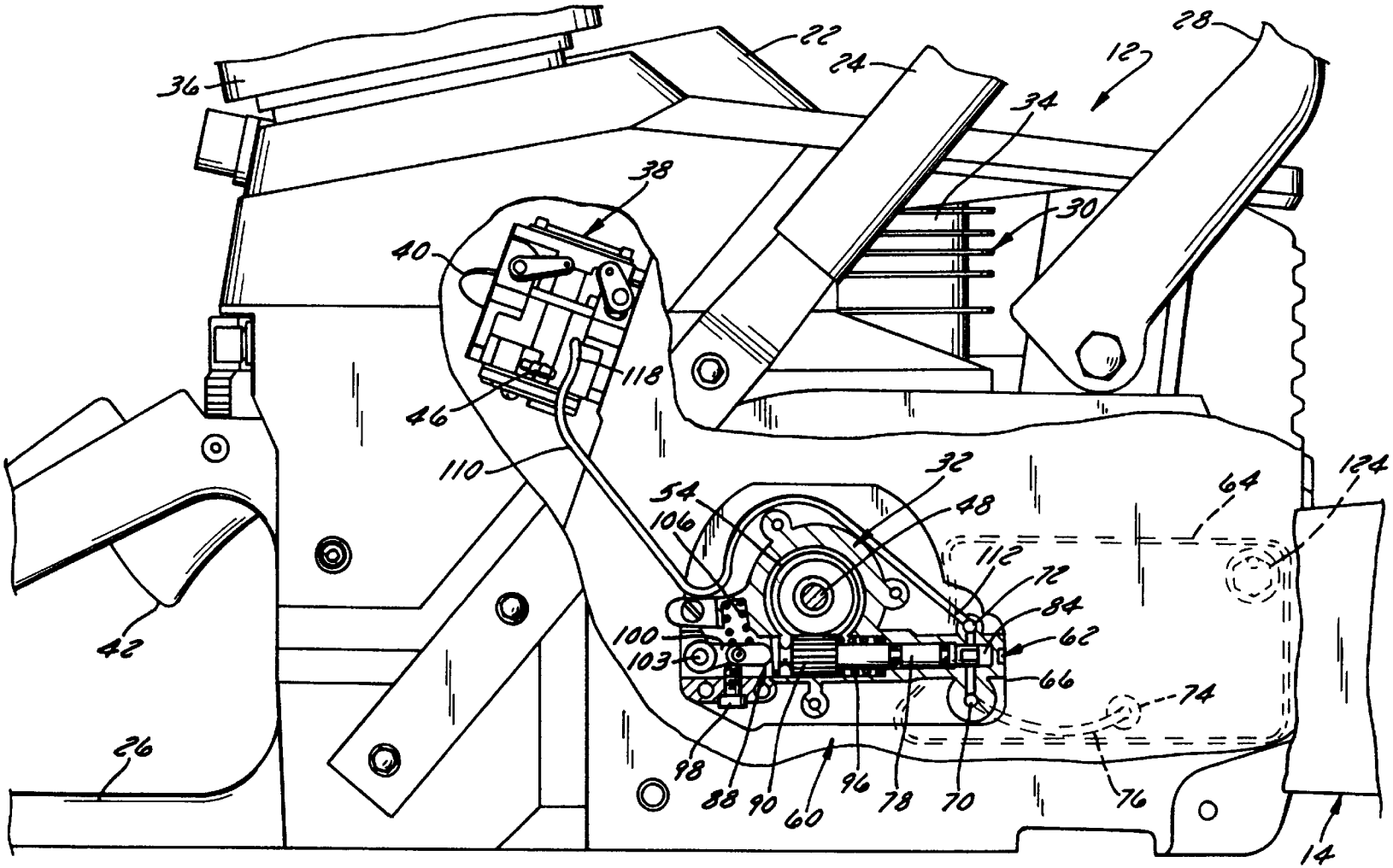
FIG. 2 is an enlarged fragmentary, partially cut away side elevation view of the power head of FIG. 1.

Referring now to the drawings and initially to FIGS. 1 and 2 in particular, a rail saw 10 is illustrated having a power head 12, a support boom or bar 14 having near and distal ends 16 and 18, and an abrasive rotary cutting disc 20. The disc 20 is rotatably mounted on the distal end 18 of the bar 14 and is driven to rotate by conventional V belt (not shown). The near end 16 of the bar 14 is bolted or otherwise affixed to the power head 12 in the conventional manner.

The power head 12 preferably comprises a Husqvarna Model 3120 power head converted for use with a rail saw in a manner which is, save for the modification of the oil metering system and lubricating oil cap as detailed below, conventional. The power head 12 therefore includes 1) a casing 22 to which are attached front and rear handles 24 and 26 and a front safety bar 28, 2) an engine 30 disposed within the casing 22, and 3) a drive train 32. The engine 30 comprises a conventional two cycle engine having a single cylinder 34, a fuel source (not shown), an air source represented by an air filter cap 36 in the drawings, and a fuel supply system including a carburetor 38.

Figure 6:
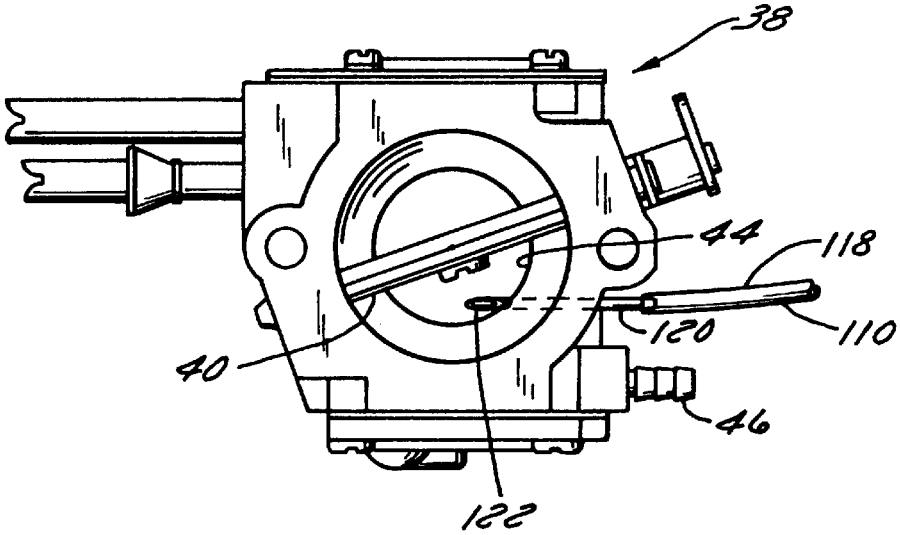
FIG. 6 is a top plan view of a carburetor and oil supply needle of the power head of FIG. 2.

Referring especially to FIG. 6, the carburetor 38 includes an outlet (not shown) in fluid communication with the intake port of the cylinder 34, a throttle plate 40 located upstream of the outlet and controlled mechanically by a throttle trigger 42, and a venturi area 44 located upstream of the throttle plate 40. A port 46 opens into the venturi area 44 and would normally receive a gasoline/lubricating oil mixture from the fuel source. However, pursuant to the invention, the port 46 receives gasoline only, and lubricating oil is supplied to the fuel supply system from a separate oil metering system 60 as detailed below.

Figure 5:
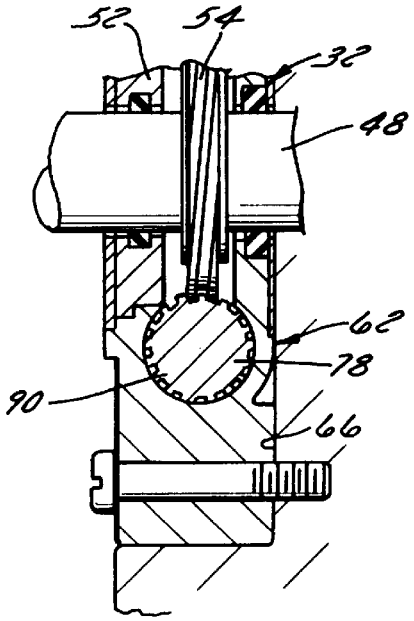
FIG. 5 is a sectional front elevation view taken along the lines 5—5 in FIG. 3.
Figure 4:
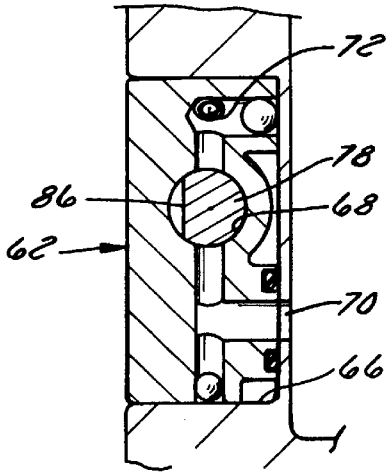
FIG. 4 is a sectional front elevation view taken along the lines 4—4 in FIG. 3.

The drive train 32 includes an output shaft 48 of the engine 30, a rotary clutch 50, and a drive pulley 52 seen only in FIG. 5. The illustrated shaft 48 and rotary clutch 50 come stock with the Husqvarna Model 3120 power head and will not be detailed. It should be noted, however, that prior practice during conversion was to remove the clutch 50 and to drive the drive pulley 52 continuously. It has been discovered that such complete disassembly is not required because the cutting disc 20 is never used under engine idle conditions. Accordingly, the stock clutch 50 is retained, and the drive train 32 is modified only by replacing the sprocket serving as a chain drive by the pulley 52 serving as a V belt drive. A worm gear 54, driven to rotate only when the clutch 50 is engaged, i.e., only when the engine 30 is operating at other than idle condition, is also retained.

Figure 3:
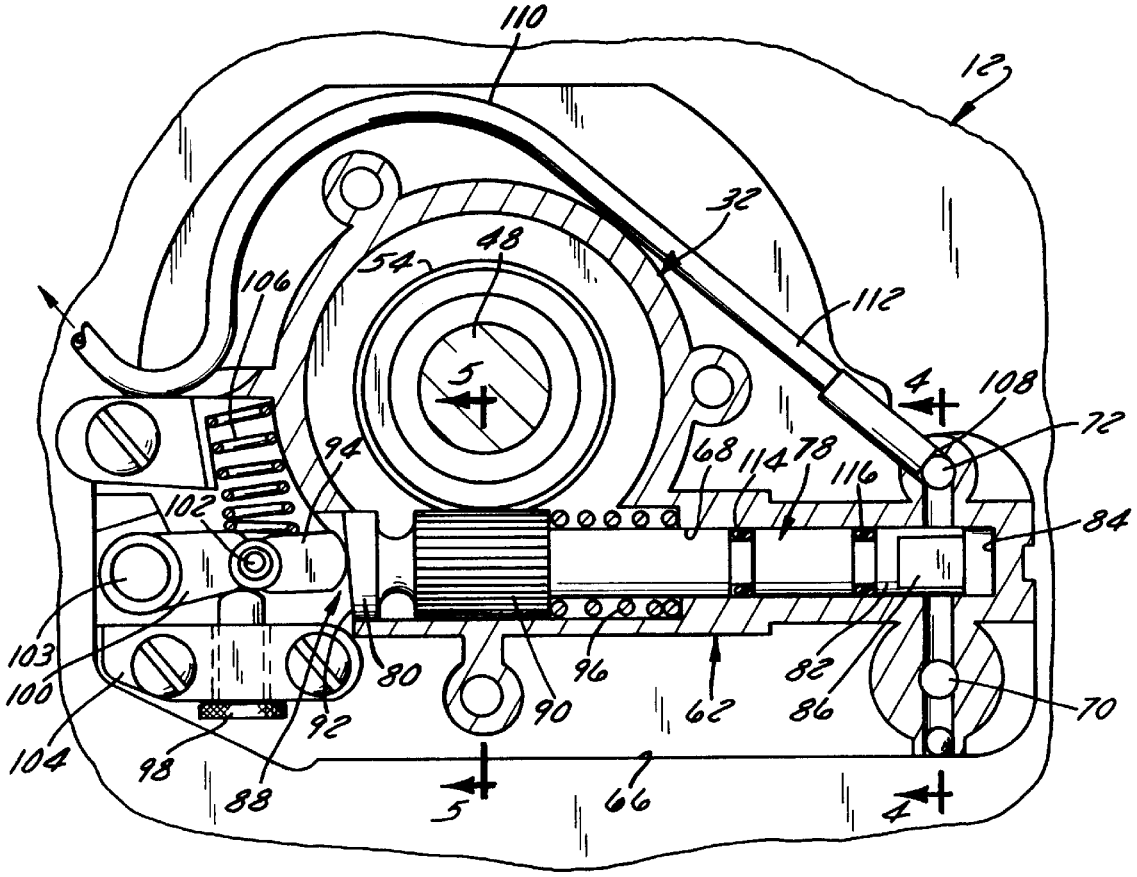
FIG. 3 is a partially cut away side elevation view of a portion of the power head of FIG. 2.

The power head 12, being designed for use with a chain saw or some other auxiliary device requiring lubrication, also comes stock with a lube oil metering system 60. The major operative component of oil metering system 60 is a cam operated reciprocating pump 62 receiving lubricating oil from an oil supply tank 64 and driven by a pump drive assembly including the worm gear 54 and a cam assembly 88. Referring especially to FIGS. 2–5, the pump 62 includes a housing 66 in which is formed a bore 68 having first and second end portions. An oil inlet 70 and an oil outlet 72 open into opposed radial sides of the second end portion of the bore 68. The oil inlet 70 is coupled by a supply line 76 to a lower outlet 74 of the lubricating oil supply tank 64. A piston 78 is mounted in the bore 68 for reciprocating sliding movement and rotational movement therein under action of the worm gear 54 and the cam assembly 88. The piston 78 has first and second end portions 80 and 82 located in the respective first and second end portions of the bore 68. A chamber 84 is formed between the second end portion 82 of the piston 78 and the second end of the bore 68. As illustrated in FIG. 3, one side face 86 of the second end portion 82 of the piston 78 is ground flat such that, when the piston 78 rotates, the inlet and outlet ports 70 and 72 in the bore 68 are successively opened to permit the introduction of oil to and the exhaustion of oil from the chamber 84. External teeth 90 are formed on the first end portion 80 of the piston 78 for mating with the teeth of the worm gear 54.

As discussed briefly above, the pump drive assembly includes the worm gear 54 and a cam assembly 88 which interact to cause the piston 78 to simultaneously rotate and reciprocate linearly with the bore 68. The cam assembly 88 includes a cam 92 and a cam follower 94. The cam 92 is formed from an end face of the piston 78 which is inclined at an angle of less than 90° with respect to the longitudinal axis of the piston 78. The cam follower 94 is formed from a bar which engages the inclined face 92 of the piston 78 at a location offset from the longitudinal center line of the piston 78 so that, when the piston 78 is driven to rotate by the worm gear 54, engagement between the inclined face 92 of the piston 78 serving as the cam and the bar 94 serving as the cam follower causes the piston 78 to reciprocate linearly. The piston 78 is biased into contact with the cam follower 94 by a return spring 96. As is conventional, the simultaneous rotation and reciprocation of the piston 78 draws a designated volume of fluid through the pump 62 per engine revolution.

The amount of fluid drawn through the pump 62 per engine revolution can be adjusted via an adjusting mechanism formed from a linkage and an adjusting screw 98. The linkage comprises the cam follower bar 94 and a second bar 100. The cam follower bar 94 is pivotally attached to the second bar 100 at a point 102, and the second bar 100 is in turn pivotally attached to the housing 66 at a point 103 remote from point 102. An adjusting screw support bar 104 is attached to the housing 66 and has a threaded bore formed therethrough for receiving the adjusting screw 98. The adjusting screw 98 extends through the bore in the support bar 104 and engages the bars 94 and 100 at the pivot point 102. Forces imposed on the bars 94 and 100 are resisted by a return spring 106 disposed opposite the adjusting screw 98. By adjusting the position of the screw 98, the location of the cam follower bar 94 relative the longitudinal axis of the piston 78 can be varied, thereby varying the amount of linear piston reciprocation occurring during each pump cycle and the resultant volume of fluid flow through the pump 62.

The oil metering system 60 as thus far described is conventional and comes stock with the Husqvarna power head. However, several relatively minor modifications are made to this stock power head to permit its oil metering system to supply lubricating oil to the engine 30 as opposed to a chain or similar accessory.

First, the oil outlet 72 as supplied by Husqvarna terminates in a casting node having a discharge opening designed to cooperate directly with the chain of a chain saw. However, pursuant to this invention, this discharge opening is plugged, and a hole is drilled in the node from the side to permit insertion of a tube ferrule 108 to which is connected an upstream end 112 of a flexible tube 110.

Second, the piston 78 typically supplied by the manufacturer is not sealed in the bore 68, primarily because the typical chain saw bar is located adjacent to the piston 78, and the manufacturer simply does not care whether or not there is some oil leakage out of the pump housing and onto the chain. Such a configuration is poorly suited for use in the present invention for two reasons. Firstly, oil leakage would be undesirable because the oil would accumulate on the drive belt for the abrasive cutting disc 20, resulting in belt slippage and a loss of performance. Secondly, precise control of the amount of oil flow through the pump 62 helps assure optimal operation of the engine 30 when the pump 62 is used as a lube oil supply source for the engine 30. Preventing fluid leakage assures more precise control of fluid flow through the pump 62. The second end 82 of the piston 78 is sealed in the bore 68 by O-rings 114 and 116 as part of the conversion process.

Third, the typical chain saw lubrication system supplies about twice as much oil per engine revolution as is required for engine lubrication, and the cam assembly 88 should be modified or at least set to prevent an oversupply of oil to the engine 30. This goal could be achieved by modifying or even precisely setting the adjusting mechanism 98, 100, etc. to limit piston reciprocation to the desired amount. However, in the illustrated and preferred embodiment, the adjusting mechanism is left alone and the face 92 of the piston 78 serving as the cam is ground down to reduce the angle of inclination. The face of the stock piston is inclined at an angle at about 80° with respect to the longitudinal axis of the piston. As part of the inventive conversion process, the face 94 of the piston 78 is ground to increase this angle to about 85°–87°, and preferably about 86°. Due to this modification, the amount of piston reciprocation at a designated radial position of the bar or cam follower 94 is decreased, reducing the supply of oil per engine revolution.

Fourth, the housing 66 is provided originally with a cable device which allows the operator to vary the position of the cam follower 94 upon demand. Such adjustment "on the fly" is unnecessary. The cable therefore is removed as part of the conversion process. However, the openings and spacings in the housing 66 designed to receive the cable provide a convenient travel path for the tube 110 through the housing 66 as illustrated in FIG. 3.

The final step in modifying the stock chain saw power head for use as the inventive rail saw power head 12 is to connect an outlet end 118 of the tube 110 to the engine's fuel supply system. This connection could be performed e.g, by connecting the outlet end 118 of the tube 110 to the system's air manifold (comprising a plastic adapter located between the cylinder head and the carburetor itself) or to the fuel line between the fuel tank and the carburetor 38. It has been discovered that manifold vacuum climbs very high when the engine 30 changes over from a wide open throttle condition to a closed throttle condition. When oil is fed into the intake manifold, this vacuum draws an excessive amount of oil through the pump 62 and into the crankcase, resulting in engine flooding. It has also been discovered that when oil is injected into the gasoline supply line, the pressure in the line tends to upset the flapper valves in the carburetor 38, leading to lean ignition.

Therefore, and pursuant to an especially preferred embodiment of the invention, oil is introduced directly into the carburetor 38, preferably into the venturi area 44 of the carburetor 38 located upstream of the throttle plate 40 as illustrated in FIG. 6. Supplying oil at this location prevents oil flooding when the engine 30 changes over from a wide open throttle condition to a closed throttle condition, and also prevents interference with operation of the flapper valves or throttle plate. Oil could be fed into the carburetor 30 by a barb, ferrule, or another device serving as a port. It has been discovered, however, that a simple hypodermic needle 120 of the type typically used by veterinarians works well for this purpose, because 1) it is inexpensive and 2) can be easily inserted directly through the side wall of the carburetor 38. Moreover, a beveled outlet 122 of needle 120 appears to create an additional venturi effect in operation, enhancing mixing of oil with gasoline in the carburetor 38. Mixing can be enhanced further by positioning the needle tip at a location which is off-set radially from the axial center of the carburetor 38.

3. Lube Oil Tank Fill Cap

A final, though not essential, step in converting a chain saw power head of the type described above to a rail saw power head is to replace the stock oil cap/dipstick assembly with an oil cap having a sight glass. The lubricating oil level of the tank of the Husqvarna Model 3120 power head, like that in most similar power heads and small four cycle engines, can be checked only by removing the oil cap and checking the level of oil on a dipstick attached to the cap. This procedure risks oil cap loss and/or introduction of dirt and other contaminants into the oil system. It has been discovered that the traditional dipstick assembly can be replaced with an oil cap having a sight glass.

Sight glasses are known in other applications. The typical sight glass has a lower conical end, appears black or dark in color when the fluid in the battery's cell in which the sight glass is located contacts the end of the sight glass, and becomes brightly colored due to reflected light when the fluid level in the cell drops below the end of the sight glass. The inventors have realized that such a sight glass can be used in an oil tank or reservoir.

Figure 7:
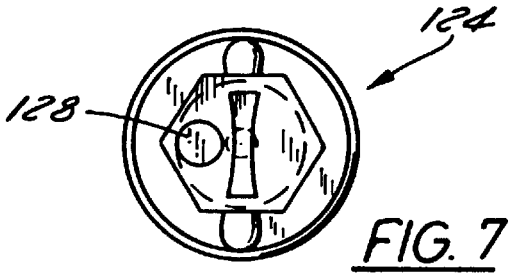
FIG. 7 is a top plan view of an oil fill cap of the power head of FIG. 2.
Figure 8:
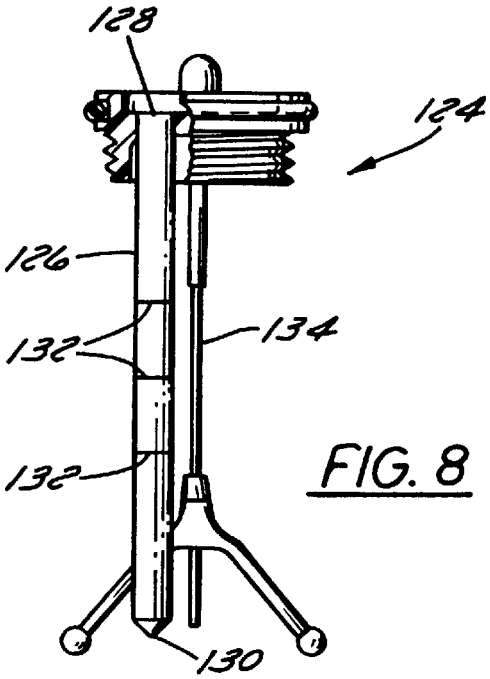
FIG. 8 is a partially cut away elevation view of the oil fill cap of FIG. 7.

Referring to FIGS. 7 and 8, an oil fill cap 124 used to close the upper opening in tank 64 (FIG. 2) is provided with a sight glass 126 which has first and second end portions. The first end portion of sight glass 126 extends through the cap 124 and terminates in a first end 128 visible from outside of the cap 124. The second end portion extends into the tank 64 and terminates in a conical second end 130. The first end 128 of the sight glass 126 is colored from reflected light when the second end 130 is not submerged in oil and appears to be black or darkly colored when the second end 130 is submerged in oil. Accordingly, the operator can be apprised of whether or not lubricating oil needs to be added to the tank 64 simply by looking at the sight glass 126. Should the operator wish to check the oil level in the tank 64 in the conventional manner, indicia 132 are preferably printed or otherwise provided on the sight glass 126 to permit it to be used as a dipstick. A conventional lanyard 134 is provided on the cap 124 to prevent cap loss should the operator wish to use it in this manner.

4. Operation of Rail Saw

In operation, the fuel tank is filled with undiluted gasoline, and the oil tank 64 is filled with engine lubricating oil. The engine 30 is then started and runs on straight gasoline so long as it is idling because the clutch 50 remains disengaged and the oil metering system 60 therefore remains inoperative. The inventors have found to their surprise that running the engine 30 on straight gasoline at idle is not only not detrimental but is actually beneficial. The engine 30 idles under ordinary operating conditions for only brief periods of time such that residual oil on the carburetor 38 and other components of the engine 30 provide adequate lubrication. Lubrication is also far less critical when the engine is idling. Indeed, lubricating the engine unnecessarily under idling conditions has been found to increase exhaust emissions and to briefly hamper engine performance upon subsequent acceleration due to oil flooding.

It is also conceivable that the engine 30 could run on straight gasoline under other conditions when engine lubrication is unnecessary. For example, there may be sufficient residual oil in the carburetor when the engine 30 changes over from a wide open throttle condition to reduced throttle condition to lubricate the engine or a limited period of time. The inventive lube oil disablement concept is intended to encompass these other conditions in addition to or instead of engine idling conditions.

When the throttle trigger 42 is activated in preparation for a cutting operation, the clutch 50 is engaged to initiate rotation of the cutting disc 20 as well as rotation of the worm gear 54 and consequent pumping action. A uniform volume of oil is consequently pumped at low pressure, during each revolution of the engine 30, from the tank 64, through the pump 62, through the tube 110, through the needle 120, and into the venturi area 44 of the carburetor 38. The oil is thoroughly mixed with gasoline and air in the carburetor before the gasoline/oil/air mixture is inducted into the cylinder. The cam assembly 88 is set by the adjusting mechanism 98, 104, etc. to achieve a gasoline to oil ratio in the cylinder 34 which is optimized for a heavily loaded engine, preferably about 25:1. By assuring optimal lubrication for worst-case operating conditions, adequate lubrication under all operating conditions is assured.

The clutch 50 remains engaged and oil continues to be supplied to the carburetor 38 so long as the throttle trigger 42 is actuated and the engine 30 is under load. When the throttle trigger 42 is released upon termination of a cutting operation to return the engine 30 to an idle condition, the clutch 50 becomes disengaged, and oil flow to the carburetor 38 discontinues. The engine 30 then runs on straight gasoline. However, as discussed at some length above, there is little or no danger to the engine 30 while it is idling or when lubrication is otherwise unnecessary.

Many changes and modifications could be made to the invention without departing from the spirit thereof.

For instance, to achieve a more sophisticated lube oil control in the disclosed embodiment, a cable mechanism could be coupled to the throttle trigger 42 and to the cam adjuster mechanism 94, 98, etc. to vary the volume of oil supplied during each engine revolution with engine load, thereby to optimize the balance between engine lubrication and emissions. In addition, as discussed above, the lube oil need not be supplied directly to the carburetor 38, although supply to the carburetor is preferred. Finally, it should be emphasized that the inventive concept is not limited to the particular power head 12 described above and that it is equally or nearly equally well suited for any power head designed for use with a chain saw or virtually any other device powered by a two cycle engine. The inventive oil metering system 60 also could be adapted for engine lubrication during initial power head manufacture rather than as a retrofit or conversion operation. The scope of these and other changes will become apparent from the appended claims.

We claim:

1. A two cycle engine comprising:

A. a cylinder having an intake port;

B. a rotatable output shaft coupled to said cylinder;

C. a fuel supply system which supplies a mixture of air, fuel, and a lubricating oil to said intake port of said cylinder; and D. an oil metering system which supplies said lubricating oil to said fuel supply system, said oil metering system including 1. a source of said lubricating oil, and 2. a metering pump having an oil inlet connected to said source of said lubricating oil and having an oil outlet connected to said fuel supply system, said metering pump being disabled to cease oil delivery to said fuel supply system and to said cylinder when engine lubrication is unnecessary while said engine is operating.

2. An engine as defined in claim 1, wherein said fuel supply system comprises a fuel source, an air source, and a carburetor connected to said fuel source and to said air source, said carburetor having an outlet in fluid communication with said intake port, a throttle plate located upstream of said outlet, and a venturi area located upstream of said throttle plate, and wherein said metering pump supplies said lubricating oil to said carburetor.

3. A two cycle engine comprising:

(A) a cylinder having an intake port;

(B) a rotatable output shaft coupled to said cylinder;

(C) a fuel supply system which supplies a mixture of air, fuel, and a lubricating oil to said intake port of said cylinder; and (D) an oil metering system which supplies said lubricating oil to said fuel supply system, said oil metering system including (1) a source of said lubricating oil, and (2) a metering pump having an oil inlet connected to said source of said lubricating oil and having an oil outlet connected to said fuel supply system, said metering pump being disabled when engine lubrication is unnecessary;

wherein said fuel supply system comprises a fuel source, an air source, and a carburetor connected to said fuel source and to said air source, said carburetor having an outlet in fluid communication with said intake port, a throttle plate located upstream of said outlet, and a venturi area located upstream of said throttle plate, and wherein said metering pump supplies said lubricating oil to said carburetor; and wherein said metering pump supplies said lubricating oil directly to said venturi area.

4. An engine as defined in claim 3, wherein said oil metering system further comprises a) a tube leading from said outlet of said metering pump to said carburetor and b) a needle which is attached to said tube and which extends through a sidewall of said carburetor and into said venturi area.

5. A two cycle engine comprising:

(A) a cylinder having an intake port;

(B) a rotatable output shaft coupled to said cylinder;

(C) a fuel supply system which supplies a mixture of air, fuel, and a lubricating oil to said intake port of said cylinder; and (D) an oil metering system which supplies said lubricating oil to said fuel supply system, said oil metering system including (1) a source of said lubricating oil, and (2) a metering pump having an oil inlet connected to said source of said lubricating oil and having an oil outlet connected to said fuel supply system, said metering pump being disabled when engine lubrication is unnecessary;

wherein said metering pump comprises a housing in which is formed a bore having first and second end portions, said oil inlet and outlet and said oil outlet opening into said second end portion of said bore, a reciprocating piston which is mounted in said bore for reciprocating sliding movement and rotational movement therein, said piston having first and second end portions located in said first end portion of said bore and said second end portion of said bore, respectively, and a pump drive assembly which is coupled to said piston and which is configured to drive said piston to selectively and alternately 1) open said oil inlet while closing said oil outlet and to 2) close said oil inlet while opening said oil outlet.

6. An engine as defined in claim 5, wherein said pump drive assembly comprises a gear which drives said piston to rotate, and a cam assembly which, upon rotation of said piston, drives said piston to reciprocate.

7. An engine as defined in claim 6, wherein said piston assembly comprises a face which is formed on said first end portion of said piston and which extends at an angle of less than 90° from a longitudinal axis of said piston, and a cam follower which engages said face of said piston.

8. An engine as defined in claim 7, wherein said angle is approximately 86°.

9. An engine as defined in claim 7, further comprising an adjusting mechanism which adjusts a position of said cam follower relative to said longitudinal axis of said piston.

10. An engine as defined in claim 6, further comprising a clutch which couples said gear to said output shaft when engaged and which is disengaged only when said engine is idling.

11. A two cycle engine comprising:

(A) a cylinder having an intake port;

(B) a rotatable output shaft coupled to said cylinder;

(C) a fuel supply system which supplies a mixture of air, fuel, and a lubricating oil to said intake port of said cylinder;

(D) an oil metering system which supplies said lubricating oil to said fuel supply system, said oil metering system including (1) a source of said lubricating oil, and (2) a metering pump having an oil inlet connected to said source of said lubricating oil and having an oil outlet connected to said fuel supply system, said metering pump being disabled when engine lubrication is unnecessary while said engine is operating; and (E) a clutch which couples said metering pump to said output shaft when engaged and which is disengaged only when said engine is idling.

12. A two cycle engine comprising:

(A) a cylinder having an intake port;

(B) a rotatable output shaft coupled to said cylinder;

(C) a fuel supply system which supplies a mixture of air, fuel, and a lubricating oil to said intake port of said cylinder; and (D) an oil metering system which supplies said lubricating oil to said carburetor, said oil metering system including (1) a source of said lubricating oil, and (2) a metering pump having an oil inlet connected to said source of said lubricating oil and having an oil outlet connected to said fuel supply system, said metering pump including (a) a housing in which is formed a bore having first and second end portions, said oil inlet and said oil outlet opening into said second end portion of said bore, (b) a reciprocating piston which is mounted in said bore for reciprocating sliding movement and rotational movement therein, said piston having first and second end portions located in said first end portion of said bore and said second end portion of said bore, respectively, (c) a gear which drives said piston to rotate, and (d) a cam assembly which, upon rotation of said piston, drives said piston to reciprocate.

13. An engine as defined in claim 12, wherein said fuel supply system comprises a fuel source, an air source, and a carburetor connected to said fuel source and to said air source, said carburetor having an outlet in fluid communication with said intake port, a throttle plate located upstream of said outlet, and a venturi area located upstream of said throttle plate, and wherein said metering pump supplies said lubricating oil directly to said venturi area of said carburetor.

14. An engine as defined in claim 12, further comprising a clutch which couples said gear to said output shaft when engaged and which is disengaged only when engine lubrication is unnecessary.

15. A rail saw comprising:

(A) a two cycle engine comprising including (1) a cylinder having an intake port, (2) a rotatable output shaft coupled to said cylinder, (3) a fuel supply system which supplies a mixture of air, fuel, and a lubricating oil to said intake port of said cylinder, (4) a clutch which is coupled to said output shaft when engaged and which is disengaged only when engine lubrication is unnecessary, and (5) an oil metering system which supplies said lubricating oil to said carburetor, said oil metering system including (a) a source of said lubricating oil, and (b) a metering pump having an oil inlet connected to said source of said lubricating oil and having an oil outlet connected to said carburetor, said metering pump being coupled to said clutch so as to be operative only when said clutch is engaged, and (B) a rotary cutting disc; and (C) a drive device which is coupled to said clutch and to said cutting disc and which drives said cutting disc to rotate only when said clutch is engaged.

16. A two cycle engine comprising:

(A) a cylinder having an intake port;

(B) a rotatable output shaft coupled to said cylinder;

(C) a fuel supply system which supplies a mixture of air, fuel, and a lubricating oil to said intake port of said cylinder; and (D) an oil metering system which supplies said lubricating oil to said fuel supply system, said oil metering system including (1) a source of said lubricating oil;

(2) a metering pump having an oil inlet connected to said source of said lubricating oil and having an oil outlet connected to said fuel supply system; and (3) a clutch which couples said metering pump to said output shaft when engaged and which decouples said metering pump from said output shaft when disengaged.

17. An engine as defined in claim 16, wherein said clutch is a centrifugal clutch.

* * * * *